US012127720B2

(12) United States Patent
Ellis

(10) Patent No.: US 12,127,720 B2
(45) Date of Patent: Oct. 29, 2024

(54) PROTECTIVE ENCLOSURE FOR A BAR OF SOAP

(71) Applicant: Brix Soap Co LLC, League City, TX (US)

(72) Inventor: Cameron Ellis, League City, TX (US)

( * ) Notice: Subject to any disclaimer, the term of this patent is extended or adjusted under 35 U.S.C. 154(b) by 0 days.

(21) Appl. No.: 18/604,774

(22) Filed: Mar. 14, 2024

(65) Prior Publication Data

US 2024/0315494 A1 Sep. 26, 2024

Related U.S. Application Data

(60) Provisional application No. 63/492,236, filed on Mar. 26, 2023.

(51) Int. Cl.

| | |
|---|---|
| ***A47K 5/03*** | (2006.01) |
| ***B65D 25/10*** | (2006.01) |
| ***B65D 43/02*** | (2006.01) |
| ***B65D 51/16*** | (2006.01) |
| ***B65D 81/26*** | (2006.01) |

(52) U.S. Cl.

CPC ..... *A47K 5/03* (2013.01); *B65D 25/108* (2013.01); *B65D 43/0202* (2013.01); *B65D 51/1605* (2013.01); *B65D 81/261* (2013.01); *B65D 2543/00203* (2013.01)

(58) Field of Classification Search

CPC ... A47K 5/02; A47K 5/03; A47K 5/04; A47K 5/05; B65D 25/10; B65D 25/108; B65D 43/02; B65D 43/0202; B65D 51/16; B65D 51/1605; B65D 81/26; B65D 81/261; B65D 2543/00203

USPC ..... 206/77.1; 220/230

See application file for complete search history.

(56) References Cited

U.S. PATENT DOCUMENTS

| | | | | |
|---|---|---|---|---|
| 3,681,806 | A * | 8/1972 | Han | A47K 5/03 206/229 |
| 3,899,073 | A * | 8/1975 | Barr | A47K 5/03 206/815 |
| 7,789,654 | B2 * | 9/2010 | Lenard | A47K 5/09 425/395 |
| 8,317,048 | B2 * | 11/2012 | Hajichristou | B65D 43/0225 220/230 |
| 2008/0169208 | A1 * | 7/2008 | Li | A47K 5/05 220/601 |
| 2022/0202261 | A1 * | 6/2022 | Tran | A47K 5/05 |

* cited by examiner

*Primary Examiner* — Bryon P Gehman

(74) *Attorney, Agent, or Firm* — Kearney, McWilliams & Davis, PLLC; William Yarbrough

(57) ABSTRACT

A protective enclosure for a bar of soap that is designed to securedly fix a bar of soap to a base, itself exhibiting receiving and securing mechanism, a centralized ventilation port and drain (or drains), and an occlusive top enclosure, wherein, once the soap is fixed to the securing mechanisms, through the application of force, and subsequent to first use, the soap and base of the protective enclosure form an adhesive seal facilitated by said securing mechanisms and drain or drains. The top enclosure and base themselves are reversibly adherable to one another through magnetic, mechanical means or a combination of both. The soap can be used either attached to the base of the protective enclosure or detached from the base of the protective enclosure.

17 Claims, 6 Drawing Sheets

PROTECTIVE ENCLOSURE FOR A BAR OF SOAP

CROSS-REFERENCE TO RELATED APPLICATIONS

U.S. Provisional Application No. 63/492,236 filed Mar. 26, 2023

FEDERALLY SPONSORED RESEARCH OR DEVELOPMENT

Non-Applicable

REFERENCE TO RELATED PATENTS

The present application claims priority to the previously filed provisional application No. 63/492,236 filed Mar. 26, 2023.

FIELD OF THE INVENTION

The present invention relates to a protective enclosure for a bar of soap, generally. The shape of the enclosure may be altered to accommodate the shape of the bar of soap. Specifically, the protective enclosure is a soap case that is designed to securedly and releasable fix a bar of soap to a base, itself exhibiting receiving securing mechanisms, a centralized ventilation port and drain (or drains), and an occlusive cover, wherein, once the soap is fixed to the securing mechanisms, through the application of force, and subsequent to first use, the soap and base of the protective enclosure form an adhesive seal facilitated by said securing mechanisms and drain or drains. The occlusive cover and base are reversibly adherable to one another through magnetic attraction, mechanical means or a combination thereof.

BACKGROUND

Historically, bars of soap, when not in use, garner very little attention. These bars of soap are, more often than not, left to their own devices and maintained and stored completely outside of any receiving tray. And while soap relies on water for its primary functionality and lathering action, an excess of water in this unprotected state leaves the soap subject to expedited deterioration due to sustained contact between accumulated water and the sides and, untoward, to the underside of a bar of soap.

In this instance, the bar of soap itself suffers from one of a number of deleterious effects from water wherein placing the bar of soap on a shower ledge or on a sink's edge allows the soap to maintain contact with the water accumulated during use as well as environmental water from the surrounding area. The soap thereby remains damp, due to this contact, and is made to exhibit a semi-solid and gelatinous state, especially on inferior portions, that remains moist during the time of non-use.

Alternatively, consumers may employ a receptacle and support surface as a means of not only securedly maintaining a bar of soap in a discrete area but also potentially allowing for air circulation due to elevation and drainage.

In this second instance, the effects of continuous contact with water may be mitigated by placing a bar of soap in a dish or like receptacle for ensuring that the bar of soap remains stationary while equally supplying a throughway for water drainage. To facilitate this air flow, "ribs" "pillars" or other elevating portions may be introduced into the soap dish to expose the underside of a bar of soap to ambient air as to allow for drying and re-solidification between uses. However, drainage may be insufficient and even elevated platforms may retain residual water wherein this retention of water may nevertheless allow residual water to reach the underside of the bar of soap, through inadequate drainage, excess water retention, or a combination thereof, and the receiving receptacle may nonetheless add to and aid water retention and leave too little space for soap drying and all resulting in obfuscation of the receptacles primary purpose-drying.

What is more, while dishes or receptacles may transitorily function properly, allowing for water drainage and soap drying, inadequacies remain in terms of expedited and additional soap disintegration due to manual manipulation during washing, hastened dissolution due to contact with the dish surface as well as an inability to transport soap once it is placed within a receiving receptacle.

While strides have been made to overcome the inadequacies of extending the useful life of bar soap, it remains evident that considerable failings remain in the field and functionality across the industry is amenable to great improvement. It is in light of the above shortcomings, inventor seeks to remediate the deficiencies of previous failed attempts to address the long felt need for extending soap integrity and method of provision thereof, that adequately serves the need of a US market alone in 2022 of over a 200 million units and a global market size of almost 30 billion.

While inventor has set forth the best mode or modes contemplated of carrying out the present invention known to the inventor, such as to enable a person skilled in the art to make and practice the present invention, the preferred embodiments are, however, not intended to be limiting, but, are, on the contrary, included in a non-limiting sense apt to amendments, alterations, alternatives and modifications, based primarily on soap sizes and consistencies, in light of specification and appended claims forming the current disclosure.

BRIEF SUMMARY OF THE INVENTION

A protective enclosure for a bar of soap is provided herein which is comprised of a largely flat base and a recessed top lid or a top enclosure. The protective enclosure is designed to secure the bar of soap to the base of the protective enclosure, which further attaches to the lid of the protective enclosure, to maintain the bar of soap in a fixed position during transportation or storage, and to prevent contact by the bar of soap with surfaces where the protective enclosure may be stored during transportation or storage, including, but not limited to, bags, suitcases, countertops, shelves, shower stalls, bathtubs, tables, and other surface areas.

The base and lid of the protective enclosure may have a plurality of surfaces and one or more walls where the protective enclosure may be transitionally occlusive (i.e., capable of opening and closing) and serves to both fix a bar of soap and to protect the soap from dislodging during transport. What is more, the protective enclosure itself may be in the form of one or more geometric or ornamental shapes, including, but not limited to, a square, rectangle, cube, circle, cylinder, pentagon, hexagon, other geometric shapes, or other ornamental shapes.

In one embodiment of the present invention that is a protective enclosure, the protective enclosure may be in the form of an aesthetic or ornamental shape that is pleasing to a child, including, but not limited to, an animal, vehicle, toy, or other shape. The top enclosure and base may be of the same color or different colors, including materials that are opaque, translucent, multicolored, and/or fluorescent colors. The top enclosure, the base or both may have images or artwork. The base and lid of the protective enclosure may further include a plurality of through-openings, drains or slots which may be placed and dimensioned on top, bottom and/or sides to allow flow of air for ventilation purposes, as well as draining and/or evaporation of excess moisture from the bar of soap, the protective enclosure or a combination thereof.

The base of the protective enclosure may include one or more securing mechanisms to secure the bar of soap to the base, including, but not limited to tabs, spikes, teeth, pegs, barbs, points, or other protrusions, located along the superior surface of the base. The securing mechanisms are placed and dimensioned to attach to or penetrate the bar of soap when the bar of soap is pressed to the base to secure the bar of soap to the base, and to support the bar of soap to prevent contact by the bar of soap with other surfaces where the protective enclosure may be stored during transportation or storage, including, but not limited to, bags, suitcases, countertops, shelves, shower stalls, bathtubs, tables, and other surface areas. In one embodiment of the base of the protective enclosure, the base of the protective enclosure may include one or more cross-shaped protrusions placed and dimensioned in one or more geometric shapes or orientations which are designed to penetrate the bar of soap to secure the bar of soap to the base.

The bar of soap to be secured to the base of the protective enclosure and enclosed by the joining of the base and the top enclosure may be in the form of one or more geometric or ornamental shapes, including, but not limited to, a square, circular, oblong, rectangle, cube, circle, cylinder, pentagon, hexagon, other geometric shapes, or other ornamental shapes. In one embodiment of the bar of soap to be secured to the base of the protective enclosure, the bar of soap may be in the shape of a rectangular prism.

The base and lid (top enclosure) of the protective enclosure may also include one or more closure mechanisms to secure the base and lid together, including, but not limited to, magnets, magnet and reciprocal metal, interlocking mechanism, notches, tabs, pins, clips, beveled sides, tongue and groove joints or a combination thereof, attached to or inserted in the base and lid to enclose the bar of soap and prevent contact by the bar of soap with other surfaces. The protective enclosure may be stored during transportation or storage, including, but not limited to, in bags, in suitcases, on countertops, on shelves, in shower stalls, in bathtubs, on tables, and on other surface areas. In one embodiment of the protective enclosure, the base and lid of the protective enclosure may include one or more magnets inserted into each which can be connected to secure the base and lid together.

Additionally, the base may exhibit, about its perimeter, one to a plurality of magnets, evenly or unevenly distributed about the base and lids perimeters, corresponding with reciprocal metal in the lid of the protective enclosure as to provide precise mating of the base and top enclosure of the protective enclosure and secure closure of the protective enclosure. It is to be understood that the opposite may be true wherein the magnetically charged elements may reside in the top enclosure and the reciprocal metallic surfaces may be in the base of the protective enclosure. Moreover, magnetically charged elements and metallic surfaces may alternate (e.g., magnetic surfaces alternating with metallic surfaces about the base with reciprocal, but opposite, configurations in the lid).

The protective enclosure may be fabricated from a pliable material such as flexible plastic, rubber, or silicone or a combination thereof. Alternatively, the protective enclosure may be fabricated from a substantially rigid material such as a hard plastic, wood, ceramic, composite, or metal alloy, recyclable materials, injectable materials, or a combination thereof. It is further contemplated that the materials for construction of the protective enclosure may be a combination of the aforementioned materials, both plastic and rigid, wherein a ratio of plasticity to rigidity may be achieved through a combination of materials as conditions, durability, longevity and utility may dictate. Too, the construction of the protective enclosure may be achieved through additive manufacturing.

A method of use and enclosing with and securing a bar of soap into a protective enclosure while maintaining the soap in a fixed position to prevent contact with other surfaces as well as maintaining the integrity of the soap during periods of non-use and during transportation or storage is also provided herein. A method of placing and maintaining a bar of soap in the protective enclosure as contemplated by inventor comprises the steps of:

- removing a bar of soap from a container or overwrap;
- applying pulling forces greater than the attractive forces of the adherable securing mechanisms described herein;
- opening said protective enclosure;
- accessing the base of said protective enclosure;
  - said base having a superior surface, an inferior (bottom) surface and opposing walls about the perimeter of said base;
- exposing the securing mechanisms to said bar of soap;
- positioning said soap atop and onto said securing mechanisms;
- applying force sufficient to penetrate said soap with said securing mechanisms;
- continuing application of force until said soap is flush with the superior portion of said base; and
- utilizing said soap in bathing.

Yet another method of use is contemplated, in connection with the above method, by inventor after initial use comprising the steps of:

- allowing excess moisture to evaporate at ambient temperatures from said soap; and
- allowing for the solidification and strengthening, from soap being dislodged, the bond(s) to securing mechanisms, via evaporation, between securing mechanisms and soap.

Still yet another method of use in connection with the above method as contemplated by the inventor after the use of the soap comprising the step of:

- allowing the soap to dry after use thereby freeing the soap of external moisture.

In yet another method of use after freeing the soap of external moisture as contemplated by the inventor comprising the step of:

- attaching the top enclosure to the base for securement, transport, and storage of said soap.

In yet another method of use after attaching the top enclosure as contemplated by the inventor, comprising the steps of:

- opening the protective enclosure for next use; and
- using the bar of soap until the contents of said bar have dissipated to the point requiring soap replacement.

In still yet another method of use as contemplated by the inventor, the mechanisms for securing the soap are placed perpendicular to the base surface and may comprise posts, pylons, shafts, pickets or supports.

In yet another method of use as contemplated by the inventor, the soap may be dislodged from the base prior to utilizing in bathing and then secured to the base after bathing.

And yet another method of use is further contemplated, in connection with the above methods, wherein the protective enclosure is reversibly closable (i.e., openable and closable) via the following steps comprising:

- inserting within the depth of the walls of base of said protective enclosure and the depth of the walls of top enclosure of the protective enclosure, a reciprocal mating magnetic material and metallic material pair or pairs whereby the magnetic and metallic materials are attracted to each other and form a bond that is overcomable with the application of sufficient of pulling force;
- removing said top enclosure from said base with the application of said sufficient force.

BRIEF DESCRIPTION OF THE DRAWINGS

So that the manner in which the present invention can be better understood, certain illustrations, charts and/or flow charts are appended hereto. It is to be noted, however, that the drawings illustrate only selected embodiments of the inventions and are therefore not to be considered limiting of scope, for the inventions can admit to other equally effective embodiments and applications.

Moreover, advantages and other aspects of the invention will be readily appreciated by those persons having skill in the art and may be better understood with further reference to the accompanying drawings in which like reference characters designate like or similar elements throughout the several figures of the drawings and wherein.

However, it should be understood that the above described figures are not intended to be limited to only the invention illustrated and to the particular embodiments disclosed, but on the contrary, the intention is intended to disclose all modifications, alternatives and equivalents falling within the spirit and scope of the invention as defined within the claim's broadest reasonable interpretation consistent with the specification. To wit, variations in height, length, width made be accomplished as to accommodate variances in sizes and shapes of bars of soap, conditioner and/or shaving bars as may be necessary or required.

DETAILED DESCRIPTION OF THE PREFERRED EMBODIMENTS

A detailed description of the preferred embodiments of the invention is disclosed and described below. Yet, each and every possible feature, within the limits of the specification, are not disclosed as various iterations are postulated to be in the purview and contemplation of those having skill in the art. It is therefore possible for those that have requisite skill in the art to make and practice the disclosed invention while observing that certain features and spatial arrangements are relative and capable of being scaled, adapted, arranged at various points about the present invention (by inventor, manufacturer or both) that nonetheless accomplishes the remediation of one or more of the infirmities as outlined and discussed above in the field of bar soap storage, encasement, securement, transport, design and use. As well, individual components of the present invention may be sized (i.e. enlarged or shrunken) so long as the proportions are maintained that allow for maintaining of esthetic appearance and proper functioning of the present invention that may be sized and shaped according to the size and shape of the inserted bar soap.

Equally, it should be observed that the present invention can be understood, in terms of structure, function, or both, from the present disclosure as well as those appended claims taken in context with the associated drawings. And whereas the present invention and method of use are capable of several different embodiments and permutations, which can be modified into several different configurations, each exhibiting accompanying interchangeable functionalities, without departing from the scope and spirit of the present application as shown and described.

Figure 1:
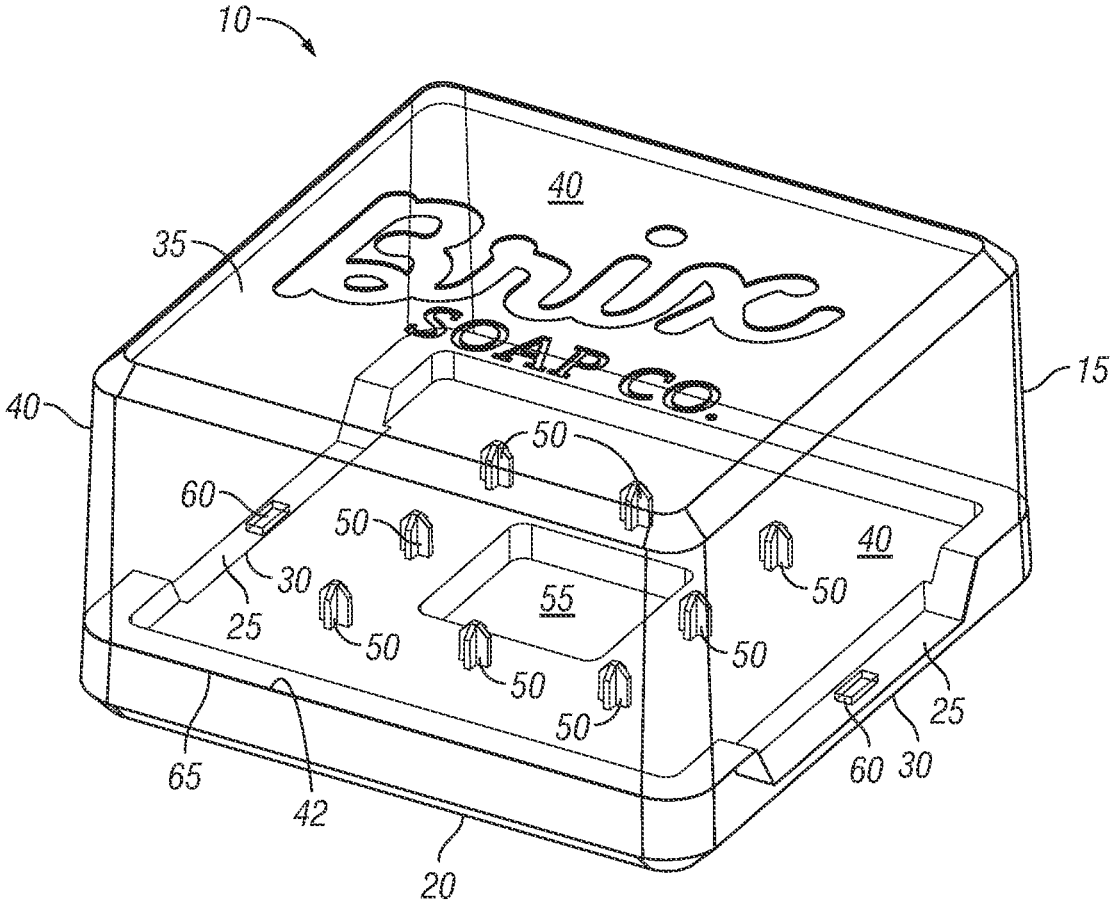
FIG. 1 is a wireframe, perspective view of a protective enclosure of the present invention in a closed orientation.

As detailed in FIG. 1, the present invention that is a protective enclosure 10 for a bar of soap, which is presented in a closed confirmation, wherein top enclosure 15 is reversibly connected to a base 20 via the mating of mirrored and reciprocating features (protrusions 25 and recesses 30). The top enclosure itself consists of a top surface 35 in connection with four (4) side surfaces 40, themselves extending downward and away from said top surface 35 and positioned substantially orthogonally (in a perpendicular plane to the top surface plane). Substantially orthogonally, as it pertains to the present invention and positioning, is defined as being largely perpendicular and within ten degrees of a right angle created at the juncture between top surface 35 in connection with four (4) side surfaces 40. Additionally, as may be seen in FIG. 1, the base 20 also evidences on its superior surface one to a plurality of securing mechanisms 50, perpendicular to said superior surface of base 20, which may be "posts", "pylons", "pillars", "shafts" "pickets" or "supports" for the affixing of a bar of soap (not shown). Too, FIG. 1 exhibits a centrally disposed drain 55 or the drainage of excess water (from the placed and positioned bar of soap and/or ambient water supplied as a result of the soap's use remaining within protective enclosure 10. The enclosure is further facilitated by adherence facilitating mechanisms to facilitate proper alignment and reversable securement which may include, but are not limited to beveled surfaces, tongue and groove (reciprocating) surfaces, snaps, or adherence facilitators (i.e., magnetically charged surfaces 60).

As depicted in FIGS. 1, 2, 6 and 8, magnetically charged structures 60 may consist of sets of reciprocally polarized surfaces (e.g., north and south poles or magnetic and metal surfaces or structures) which exhibit attraction to one another and may assist in maintain a closed conformation. The confirmation may then be reversibly changed (from open to closed) through the application of force greater than the forces of magnetic attraction between magnetic structures and metal. The result of this application of force is evidenced by the separation of top enclosure 15 from base 20 in FIG. 2 wherein corresponding magnetically charged structures 60*a* may be "like" charged (i.e., both exhibiting magnetically charged structures) or unequally charged (i.e., a charged structure and a metallic structure). Likewise, magnetically charged structures 60*b* may exhibit "like" polarization or oppositely charged (e.g., magnetically charged and metallic surfaces), but wherein each of magnetically charged structures 60*a* and 60*b* are oppositely charged and made to face a metallic surface which are exhibited as "mated pairs". What is more, side surfaces 40 are further subdivided into side surfaces 40*a* and 40*b*. Side surfaces 40*a* are diametrically opposing to one another and exhibit a relative horizontal uniformity between those edges forming a connection with the top surface 35, superiorly at top edge 41, and bottom edge 42, inferiorly. In opposite, side surfaces 40*b* evidence a horizontal surface, superiorly, at top edge 43 (similar to top surface 41) and a "lip" or protrusion 45 inferiorly at side surface 40*b*. This protrusion 45 is designed to mate with recesses 70 on base 20, align magnetically charged surfaces with metallic surfaces (structures 60*a* and 60*b*) and facilitate enhanced adhesion of top enclosure 15 reversibly to base 20. Magnetically charged surfaces 60*a* are inserted within protrusion 45 of top enclosure 15 and centrally located (at a point equidistant for either enclosure corner) while metallic surfaces 60*b* are retained within the lower lip 63 created within the outer edge of base 20. Yet, this configuration may consist of metallic structures 60*a* and magnetically charged structures 60*b* or alternating magnetically charged structures 60 with metallic structures 60.

Moreover, it is contemplated by inventor to incorporate one or more closure mechanisms (described also above), which may be utilized together with or in lieu of magnetically charged structures, as to provide facilitated closure and securement. These mechanisms may consist of one or more interlocking, lipped, tongue and groove and/or beveled surfaces.

Figure 6:
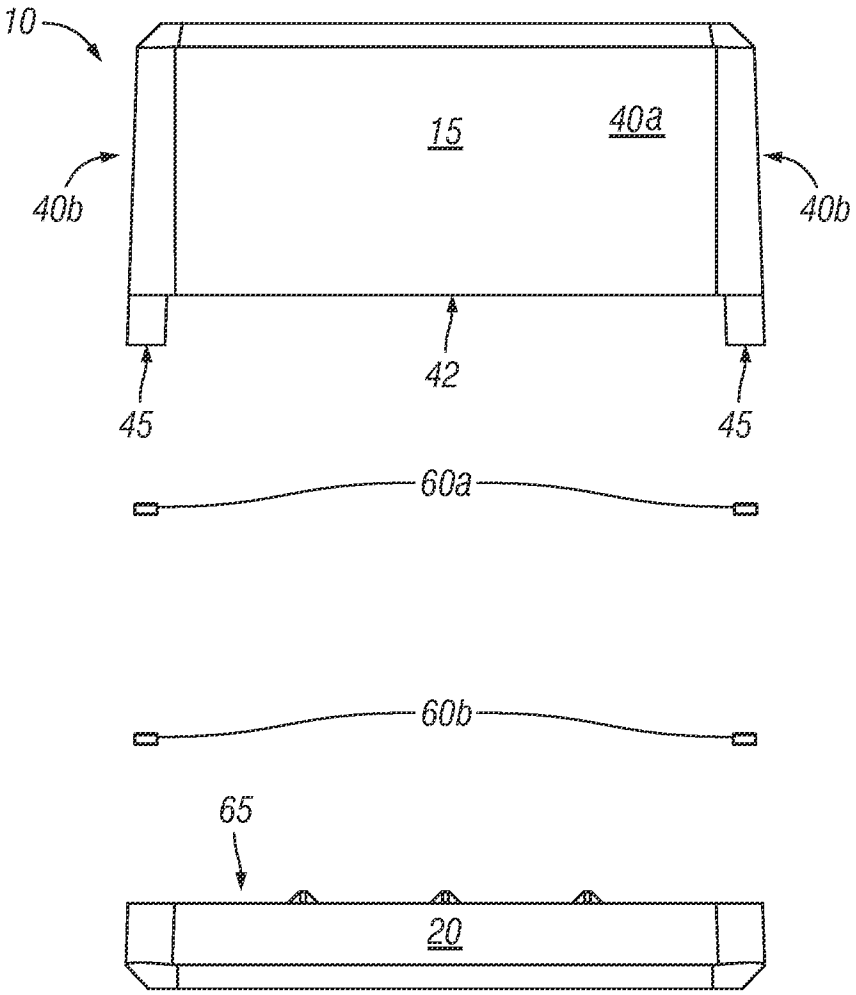
FIG. 6 depicts a front view of the embodiment of FIG. 5 in an open confirmation.
Figure 5:
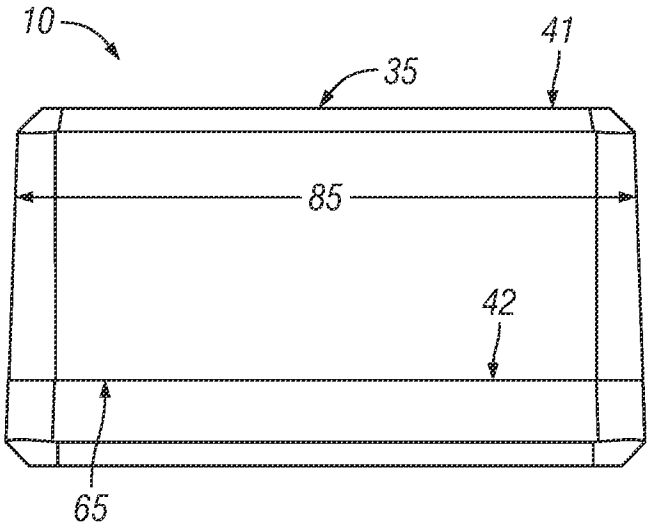
FIG. 5 shows a front view of another rectangular embodiment of the present invention in a closed confirmation.

As is shown in FIGS. 1, 5 and 6, base 20 itself exhibits a largely uniform (raised) surface 65 which is made to correspond with surface 42 of top component 15. This mating of surfaces 42 and 65 create a flush and level communication whereby top component 65 is made to "rest" atop surface 42. However, it should be noted that, if the invention is inverted (e.g., rotated 180 degrees), the same relationship would exist between surfaces 65 and 42 and wherein surface 42 may be seen to rest atop surface 65.

Figure 2:
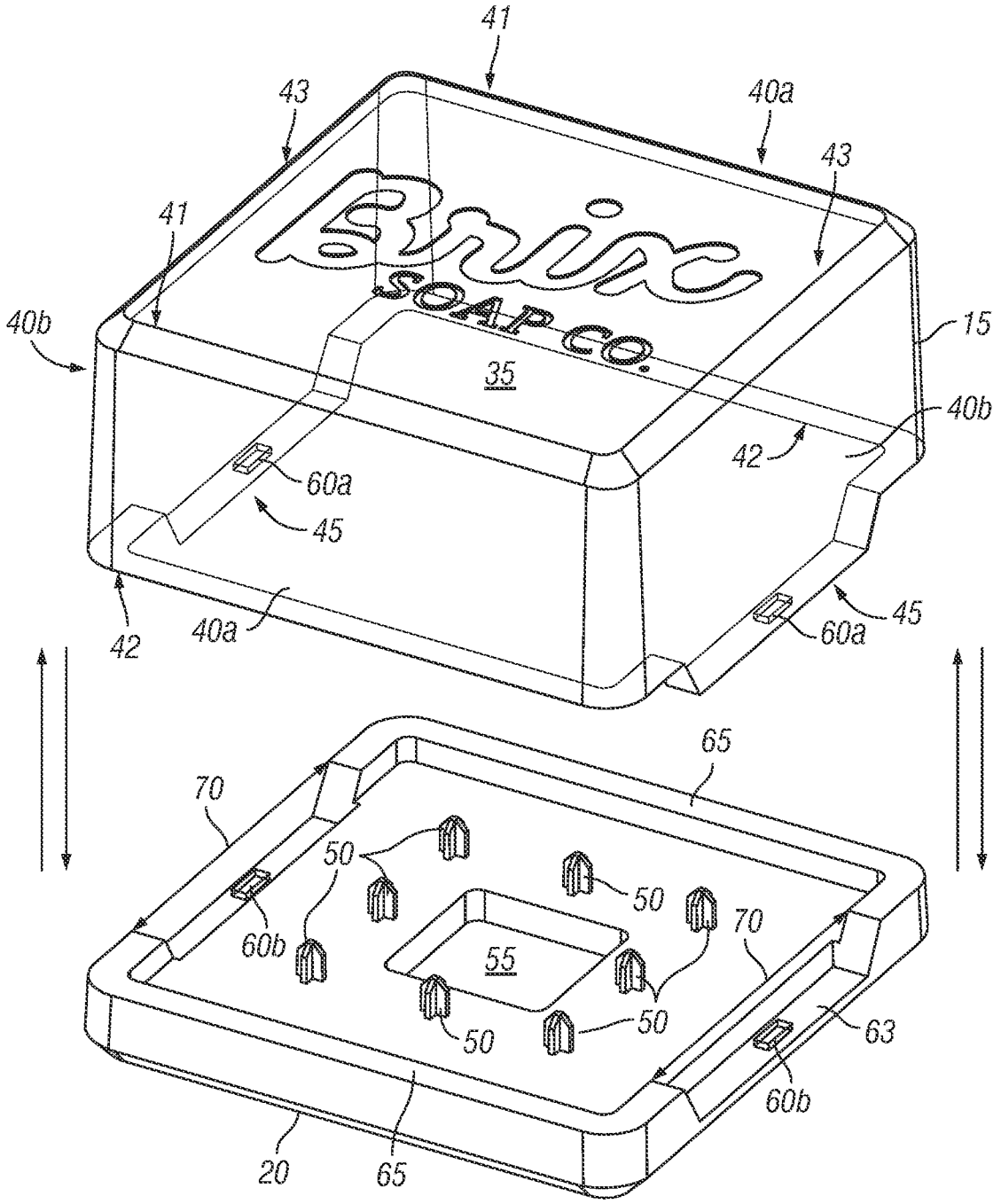
FIG. 2 is a wireframe perspective view of the protective enclosure of FIG. 1 showing an open configuration.
Figure 3:
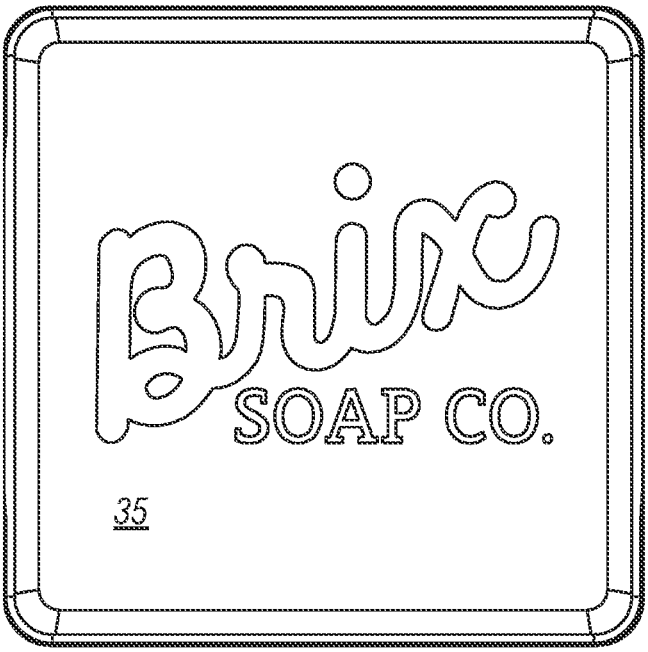
FIG. 3 is a top view of the present invention.

FIG. 3 provides a superior, top view of the present invention wherein words, logos, insignias, symbols, images, or other like impressions, may be embossed or inserted into the materials utilized for the present invention's construction. As is illustrated, the edges of top surface 35 may be beveled (shown), curved, or presenting a sharp edge. It is further contemplated by inventor that top enclosure surface 35 as shown in FIGS. 1 and 2, may have one to a plurality of openings, holes or vents, evenly or unevenly placed, as to facilitate air flow and drying.

Figure 4:
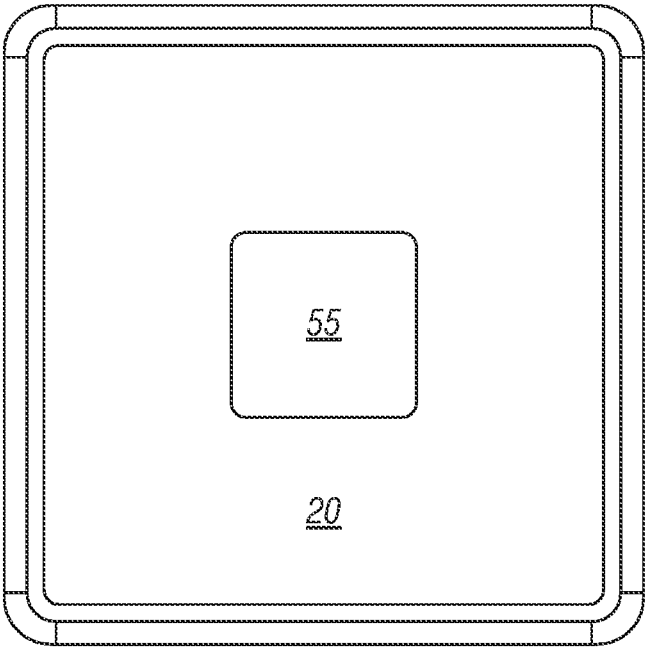
FIG. 4 illustrates a bottom view of the present invention.

In FIG. 4 the base 20, as shown in an inferior view, has provided therethrough a drain 55 and wherein said edges may likewise be beveled (shown), curved, or provided with a sharp edge. Moreover, as depicted, drain 55 is centrally located and appears as a single drain. However, it is contemplated that drain 55 may be provided in multiplicity, uniformly, offset and of various and variable sizes as to allow for proper drainage.

Figure 8:
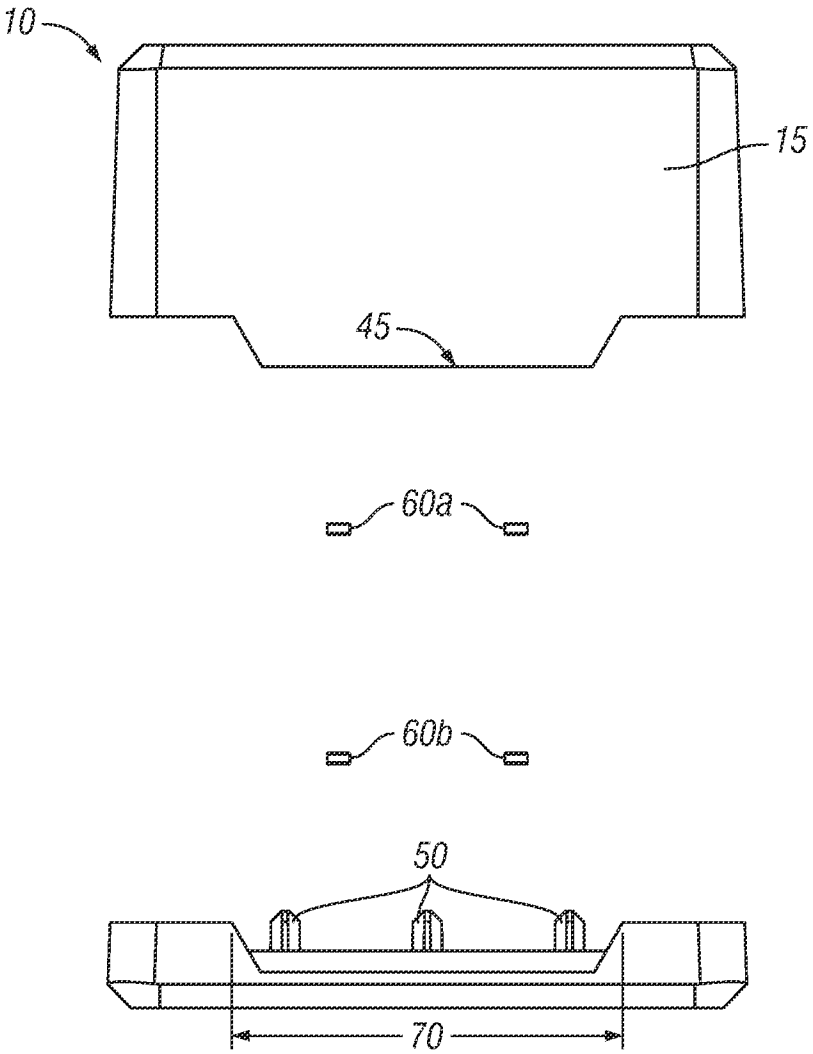
FIG. 8 depicts a side view of the embodiment of FIG. 5 in an open confirmation.
Figure 7:
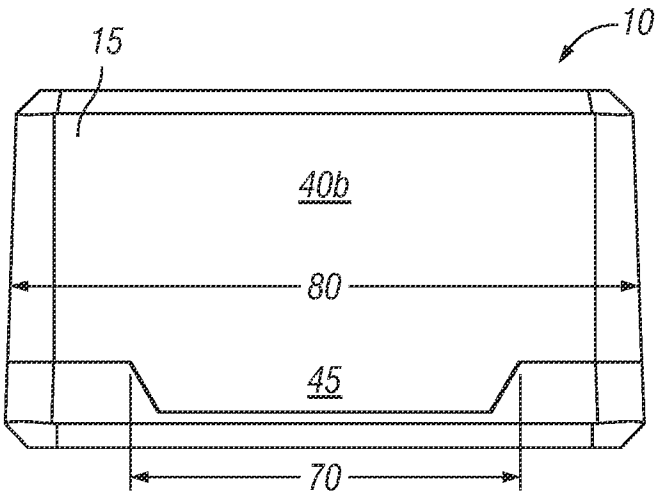
FIG. 7 is a side view of the embodiment of FIG. 5 in a closed confirmation.
Figure 10:
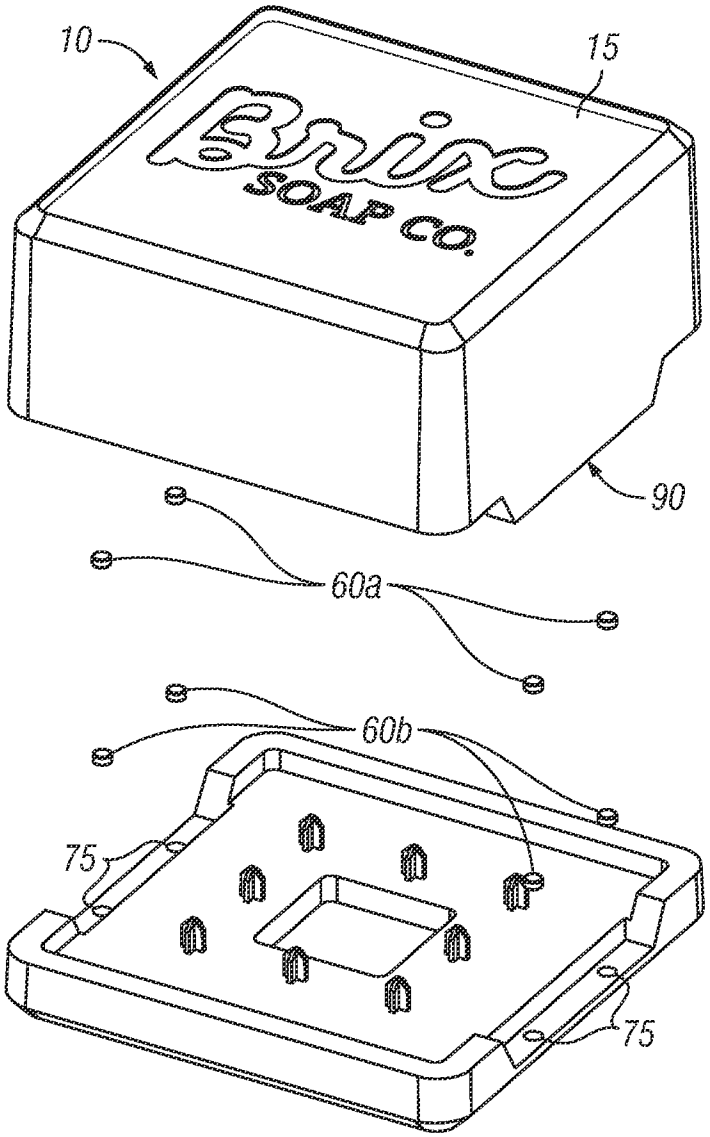
FIG. 10 shows a perspective view of the embodiment of FIG. 5 in an open confirmation.
Figure 9:
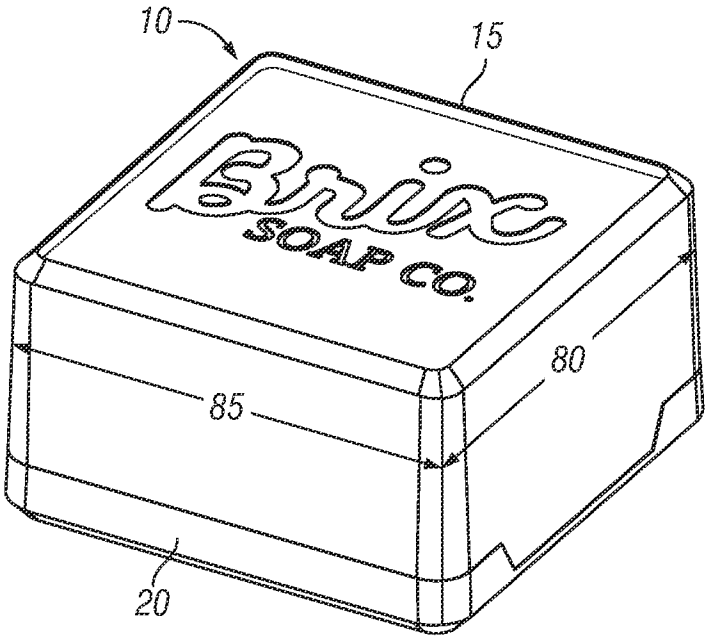
FIG. 9 is a top perspective view of the embodiment of FIG. 5 a closed confirmation.

FIGS. 5-10 represent another preferred embodiment for a largely rectangular protective enclosure wherein length 85 (illustrated in FIGS. 5 and 9) is greater than width 80 (illustrated in FIGS. 7 and 9). Further, as is contrasted between FIGS. 6 and 8 and FIG. 10, magnetically charged structures 60*a* and 60*b* in FIG. 8 are angular (rectangular) and utilize one magnetically charged pair of structures 60, centrally located, at either end of the interface between mirrored and reciprocating features (protrusions 25 and recesses 30) for reversable adhesion with 4 (four) total structures. In opposite, FIGS. 8 and 10 display cylindrical magnetically charged structures and metallic structures 60, defined further as upper magnetically charged structures 60*a* and lower magnetically charged structures 60*b*, metallic structures 60*a* and 60*b*, or a combination thereof, appearing in duplicate pairs (two structures on either side and reciprocal structures also appearing in duplicate for a total of 8 such total structures) whereby "north" and "south" poles may be in the same tandem set (i.e., magnetically charged structures 60*a* consisting of "charged" structure/"charged" structure and structures 60*b* consisting of "metallic" structures/"metallic" structures) or where each tandem set may exhibit opposite polar confirmations (e.g., magnetically charged structures 60*a*, 60*b* and metallic structures 60*b*, 60*a*) and positioned at a distance 75 on base 20 mirrored on the underside 90 of top enclosure 15. Similar to the insertion depicted in FIGS. 1 and 2, each magnetically charged structure or metallic structure is embedded into protrusion 45 of top enclosure 15 and lip 63 of base 20 through an injection molding process which creates a tight seal surrounding each magnetically charged structure.

Yet, use of pairs of magnetically charged structures/metallic structures 60, which are cylindrical and are presented in duplicate, creates two advantages when compared with square or rectangular magnetically charged structures: (1) the cylindrical shape ensures equal and uniform "holding" pressure about the structures outer surface, thereby enhancing static grip, and (2) the dual structures provide a two-fold increase in adherence forces. What is more, magnetic structures/metallic structures 60 appearing in mated pairs distributes adhesive forces over a larger area and allows for functionality even where one of the pairs may be occluded by accumulation of soap.

Although only a select few example embodiments have been described in detail above, those skilled in the art will readily appreciate that many modifications are possible in the example embodiments without materially departing from this disclosure of the invention. Accordingly, all such modifications are intended to be included within the scope of this disclosure as defined in the appended claims.

I claim:

1. A protective enclosure for a bar of soap, comprising:

a top enclosure;

said top enclosure comprised of a flat, top surface and four side surfaces extending downward and substantially orthogonally, and away from said flat, top surface;

said side surfaces having two opposite sides displaying mirrored extended protrusions;

said each extended protrusion having one or more adherable securing mechanisms installed within to secure the top enclosures with a base;

a base;

said base consisting of a flat, bottom surface;

said flat bottom surface exhibiting two raised sides;

said flat bottom surface exhibiting two mirrored recessed sides extending below the rectangular bottom surface;

said recessed sides having one or more adherable securing mechanisms installed within to secure the base with the top enclosure;

said base exhibiting a centrally disposed drain;

said base exhibiting one to a plurality of securing mechanisms to secure a bar of soap in a fixed position to the base; and wherein the top enclosure and base are reversibly adherable and secured via mating of the protrusions and recessed sides through reciprocal adherable securing mechanism.

2. The protective enclosure of claim 1, wherein said one or more securing mechanisms on the top enclosure and base comprises one of magnets, magnet and reciprocal metal, interlocking mechanism, notches, tabs, pins, clips, beveled sides, tongue and groove joints or a combination thereof.

3. The protective enclosure of claim 1, wherein said top enclosure and base may be joined, adhered through magnetic attraction and separated by overcoming said magnetic attraction.

4. The protective enclosure of claim 3, wherein magnetically charged structures in said top enclosure are oppositely charged to magnetically charged structures in said base as to create attraction.

5. The protective enclosure of claim 1, wherein the one or more adherable securing mechanisms used to secure the top enclosure to the base is are configured in the form of one or more magnetic elements which comprises one of rectangular, square, cylindrical and circular.

6. The protective enclosure of claim 1, wherein the top enclosure surface exhibits one to a plurality of venting structures.

7. The protective enclosure of claim 1, wherein the enclosure is configured in the form of one or more geometric or ornamental shapes.

8. The protective enclosure of claim 1, wherein said top enclosure and said base have same color or different colors.

9. The protective enclosure of claim 1, wherein said top enclosure or said base or both comprises one of opaque, translucent, fluorescent, uniformly colored, and multi-colored or a combination thereof.

10. The protective enclosure of claim 1, wherein said enclosure is made of one of metal, wood, plastic, rubber, silicone, ceramic, metal alloy, recyclable materials, injectable materials and a combination thereof.

11. A method of placing and maintaining a bar of soap in the protective enclosure of claim 1 comprising the steps of:

removing a bar of soap from a container or overwrap;

applying pulling forces greater than the attractive forces of the adherable securing mechanisms;

opening said protective enclosure;

accessing said protective enclosure base;

said base having a superior surface, an inferior (bottom) surface and opposing walls about the perimeter of said base;

exposing the securing mechanisms;

positioning soap atop and onto said securing mechanisms;

applying force sufficient to penetrate said soap with said securing mechanisms;

continuing application of force until said soap is flush with the superior portion of said base; and utilizing said soap in bathing.

12. The method of claim 11, further comprising, after soap use:

allowing excess moisture to evaporate at ambient temperatures from said soap; and allowing for the solidification and strengthening, from soap becoming dislodged, the bond(s) to securing mechanisms, via evaporation, between securing mechanisms and soap.

13. The method of claim 12, further comprising the steps of:

allowing said soap to dry after use thereby freeing said soap of external moisture.

14. The method of claim 13, further comprising the steps of:

attaching said top enclosure to said base for securement, transport and storage of said soap.

15. The method of claim 14, further comprising the steps of:

opening said protective enclosure for next use; and using bar of soap until the contents of said bar have dissipated to the point requiring soap replacement.

16. The method of claim 11, wherein said securing mechanisms utilized for soap securement are placed perpendicular to said base surface and may be comprised of posts, pylons, pillars, shafts, pickets or supports.

17. The method of claim 11, wherein said soap is dislodged from the base prior to utilizing in bathing and then secured to the base after bathing.

* * * * *